US005171916A

United States Patent [19]

Le et al.

[11] Patent Number: 5,171,916

[45] Date of Patent: Dec. 15, 1992

[54] LIGHT CYCLE OIL CONVERSION

[75] Inventors: Quang N. Le, Cherry Hill; Michael S. Sarli, Haddonfield, both of N.J.

[73] Assignee: Mobil Oil Corp., Fairfax, Va.

[21] Appl. No.: 715,269

[22] Filed: Jun. 14, 1991

[51] Int. Cl.[5] ..... C07C 2/66

[52] U.S. Cl. ..... 585/467; 208/46; 208/18; 585/455

[58] Field of Search ..... 585/467, 455

[56] References Cited

U.S. PATENT DOCUMENTS

| | | | |
|---|---|---|---|
| 3,574,720 | 4/1971 | DeVault | 260/505 |
| 4,181,597 | 1/1980 | Yan et al. | 208/46 |
| 4,871,444 | 10/1989 | Chen et al. | 585/467 |
| 4,954,325 | 9/1990 | Rubin et al. | 423/328 |
| 4,954,663 | 9/1990 | Marler et al. | 568/791 |
| 4,992,606 | 2/1991 | Kushnerick et al. | 585/467 |
| 5,001,295 | 3/1991 | Angevine et al. | 585/467 |
| 5,019,670 | 5/1991 | Le et al. | 585/467 |
| 5,053,573 | 10/1991 | Jorgensen et al. | 585/475 |

*Primary Examiner*—Anthony McFarlane

*Attorney, Agent, or Firm*—Alexander J. McKillop; Charles J. Speciale; Jessica M. Sinnott

[57] ABSTRACT

Alkylated aromatic functional fluids are prepared by alkylating a light cycle oil with an alkylating agent, such as an alpha $C_{14}$-olefin or coker gas oil, over a crystalline metallosiicate catalyst, preferably an aluminosilicate, including MCM-22, USY or an acid treated kaolin clay. The process produces an improved light cycle oil in which the heteroatom content of the oil is reduced and a high quality synthetic alkylated aromatic functional fluid base stock boiling above 600° F. The reactor temperature can be elevated to increase the functional fluid yield and the extent of heteroatom removal.

24 Claims, No Drawings

LIGHT CYCLE OIL CONVERSION

FIELD OF THE INVENTION

This invention relates to converting a light cycle oil in the presence of a crystalline metallosilicate catalyst to upgrade the light cycle oil.

BACKGROUND OF THE INVENTION

Effective techniques for manufacturing the greatest amount of high quality products from low quality crudes are needed for the economic viability of the petroleum refining industry. Certain crudes are considered low quality because, upon catalytic cracking of a gas oil fraction thereof, they produce large quantities of refractory, hard-to-upgrade cycle-stocks such as light cycle oils (LCO) which, in most cases, cannot be used without further processing because of their poor quality due to a high aromatics content and high levels of heteroatoms, i.e., sulfur and nitrogen atoms.

Refiners can dispose of the light cycle oil stocks by blending them with the middle distillate fuels such a diesel fuels and domestic heating fuels. This is a common method of using the light cycle oils; however, the high sulfur content of the light cycle oil can lead to cold corrosion and increased engine wear as well as exhaust pollution. Additionally, the light cycle oils make undesirable diesel blending components because the cetane numbers of these stocks can be as low as ten due to the high aromatics content and such a low cetane number prevents the diesel fuel product from meeting the minimum cetane number of 40.

Catalytic hydrodesulfurization has been used to improve the sulfur and nitrogen content and stability of the light cycle oils. The process is conducted in a separate refinery unit which removes sulfur and nitrogen compounds from the fraction. Although hydrodesulfurization is unlikely to be dispensed with because of the continuing emphasis on low sulfur products, the significant and costly hydrogen consumption involved is a major drawback. Moreover, hydrodesulfurization is not always successful in removing the heteroatoms when they are bound-up in the heavier aromatic molecules.

Recycling the untreated cycle oil fractions through the catalytic cracker has been proposed as a way to reduce the amount of LCO and convert the LCO to gasoline; however, it is persuasively disadvantageous to do this because the LCO will increase the coke make in the FCC, the quality of the LCO will be diminished and the amount of heavy cycle oil and gas will increase.

Alkylating the aromatic components of a light cycle oil with the olefins contained in the light cycle oil over liquid phase hydrofluoric acid to produce a lubricating oil is described in U.S. Pat. No. 3,574,720. Other homogenous alkylation catalysts are also described as useful in the alkylation process: they include sulfuric acid and boron triflouride. The disadvantages of this LCO treating technique include the handling difficulties and safety hazards associated with using the described homogenous catalysts. Refinery usage of these materials should be limited because of the dangers associated with use. Replacements for the harmful substances with less offensive materials are greatly needed.

A further disadvantage of the process described in U.S. Pat. No. 3,574,720 is that although it teaches converting the light cycle oils to more useful products, there is no disclosure that the unconverted light cycle oil fraction is improved by the process. Although there is a decreasing need for light cycle oils, they are still economically valuable refinery products particularly when upgraded.

A still further disadvantage of using the homogenous catalysts in the alkylation reaction is that they require downstream separation from the product. This extra process increases the refiners' operating costs.

Clearly, there is a need for cost-effective technology which can upgrade the light cycle oils. There is also a need for cost-effective techniques which can convert the light cycle oils to more valuable hydrocarbon stocks while at the same time improving the unconverted light cycle oil fraction.

SUMMARY OF THE INVENTION

This invention discloses a method of treating light cycle oils with crystalline metallosilicate catalysts to produce improved liquid hydrocarbon products; namely, improved alkylated aromatic functional fluids and improved light cycle oils in which the heteroatoms and aromatics content is reduced. The invention provides a cost effective alternative to traditional hydrogen-consuming light cycle oil upgrading processes. Alternatively, the refiner can integrate the instant light cycle oil upgrading process with the known downstream light cycle oil conversion processes such as hydrotreating and hydrocracking to improve the cost-effectiveness and efficiency of the entire light cycle oil upgrading process.

The invention reveals that crystalline metallosilicate catalysts are selective for alkylating the heteroatom-containing aromatics of the light cycle oil fraction. Thus, substantially simultaneously the light cycle oil is upgraded and an alkylated aromatic functional fluid is produced. That is, the heteroatom-containing alkylated aromatics of the light cycle oil separate into an oxidatively stable functional fluid while improving and upgrading the unconverted light cycle oil fraction.

FEEDSTOCK

The light cycle oil feed used in the instant process is very aromatic and hydrogen deficient. The fraction has been substantially dealkylated by a catalytic cracking operation such as in a FCC or TCC unit. The alkyl groups, generally bulky, large alkyl groups typically containing $C_5$ to $C_9$ alkyls which are attached to the aromatic groups, are detached from the aromatic groups during cracking to form gasoline. The high boiling one and two-ring aromatic hydrocarbon moieties left behind include benzenes, naphthalenes, benzothiophenes, dibenzothiophenes, pyrines, indoles and polynuclear aromatics such as anthracene and phenanthrene. The acid-catalyzed cracking reactions remove side chains of greater than about 5 carbon atoms, leaving behind the shorter chain alkyl groups which are usually methyl, sometimes ethyl, which are still attached to the aromatic moieties. Hence, the feedstocks include those aromatics with one or even more small alkyl group side chains remaining.

The API gravity is a measure of the aromaticity of the feed, usually, in the instant feed, being below 30 and in most cases below 25 or even lower, e.g. below 20. In most cases the API gravity will be in the range of about 5 to 25 with corresponding hydrogen contents from 8.5–12.5 wt. %. Sulfur contents are typically from about 0.5 to 5 wt. % and nitrogen contents from 50 to 2000 ppm.

Suitable feeds for the present process are substantially dealkylated cracking fractions with an end boiling point below 650° F. (345° C.), preferably below 600° F. (315° C.). Initial boiling points will usually be about 300° F. (150° C.) or higher, such as about 330° F. (165° C.) or 385° F. (195° C.). Light cut light cycle oils within these boiling ranges are highly suitable. A full range light cycle oil (FRCO) generally has a boiling point range between 385° F. and 750° F. (195° C.–400° C.). Light cycle oils generally contain from about 60 to 85 % aromatics and as a result of the catalytic cracking process, are substantially dealkylated.

The appropriate boiling range fraction may be obtained by fractionation of a FRCO or by adjustment of the cut points on the fractionation column of the catalytic cracker. The light stream will retain the highly aromatic character of the catalytic cracking cycle oils (e.g. greater than 50% aromatics by silica gel separation) but the light fractions used in the present process generally exclude the heavier polynuclear aromatics (having three rings or more) which remain in the higher boiling range fractions.

ALKYLATING AGENT

The above-described LCO feedstock is subjected to an alkylation reaction in the presence of an alkylating agent which can include any aliphatic hydrocarbon having at least one olefinic double bond which is capable of reacting with the aromatics of the LCO. Suitable alkylating agents include long chain or short chain olefins. The term "long chain" olefin means that the olefin contains about 8 or more carbon atoms, more specifically 8 to 24 carbon atoms. The term "short chain" olefin is used to mean that the hydrocarbon contains less than 8 carbon atoms, more specifically less than about 5 carbon atoms. In general, the olefin contemplated contains at least one carbon-carbon double bond and can be a 1-olefin or a 2-olefin. The olefins can be straight chain or branched.

In the instant process the long chain olefins; that is, olefins having more than 8 carbon atoms are preferred in order for the functional fluid fraction to achieve a higher viscosity index (VI). The higher VI gives the functional fluid lubricating oil qualities which the longer chain alkyl group supplies. Long chain olefin sources can be derived from light olefins ($C_2$= to $C_5$=) via olefin dimerization and oligomerization reactions.

Olefinic hydrocarbon fractions can be used quite effectively as alkylating agents. Olefinic hydrocarbon fractions contemplated include olefin streams from the FCC unit, e.g., light olefins ($C_3$–$C_4$), and FCC gasoline fractions. Preferred olefinic feedstocks also include coker products such as coker naphtha, coker gas oil, distillate gasoline and kerosene.

CATALYST

The catalysts which are contemplated for use in the invention are heterogeneous catalysts which have a solid structure such as the crystalline metallosilicate catalysts. Included among the crystalline materials are the zeolites and clays as well as amorphous silica/alumina materials which have acidic functionality.

The porous crystalline materials known as zeolites are ordered, porous crystalline metallosilicates, usually aluminosilicates, which can best be described as rigid three-dimensional framework structures of silica and Periodic Table Group IIIA element oxides such as alumina in which the tetrahedra are cross-linked through sharing of oxygen atoms. Zeolites, both the synthetic and naturally occurring crystalline aluminosilicates have the general structural formula:

$$M_{2/n}O.Al_2O_3.ySiO_2.zH_2O$$

where m is a cation, n is its valence, y is the moles of silica and z is the moles of water. In the synthetic zeolites both aluminum and/or silicon can be replaced either entirely or partially by other metals, e.g. germanium, iron, chromium, gallium, and the like, using known cation exchange techniques. Representative examples of the contemplated synthetic crystalline silicate zeolites include the large pore Y-type zeolites such as USY, REY, and another large pore crystalline silicate known as zeolite Beta, which is most thoroughly described in U.S. Pat. Nos. 3,308,069 and Re. 28,341 which are herein incorporated by reference in their entireties. Other catalysts which are contemplated are characterized as the medium pore catalysts. There are other synthetic zeolites which have been synthesized which may be useful in the instant process. These zeolites can be characterized by their unique x-ray powder diffraction data. The following Table sets forth a mere few representative examples of zeolite catalysts which are believed suitable and reference to the corresponding patents which describe them:

TABLE A

| Zeolite | U.S. Pat. No. | Zeolite | U.S. Pat. No. |
|---|---|---|---|
| MCM-2 | 4,647,442 | ZSM-25 | 4,247,416 |
| MCM-14 | 4,619,818 | ZSM-34 | 4,086,186 |
| Y | 3,130,007 | ZSM-38 | 4,046,859 |
| ZSM-4 | 4,021,447 | ZSM-39 | 4,287,166 |
| ZSM-5 | 3,702,886 | ZSM-43 | 4,247,728 |
| ZSM-11 | 3,709,979 | ZSM-45 | 4,495,303 |
| ZSM-12 | 3,832,449; 4,482,531 | ZSM-48 | 4,397,827 |
| ZSM-18 | 3,950,496 | ZSM-50 | 4,640,829 |
| ZSM-20 | 3,972,983 | ZSM-51 | 4,568,654 |
| ZSM-21 | 4,046,859 | ZSM-58 | 4,698,217 |
| Beta | 3,308,069; RE. 28,341 | | |
| x | 3,058,805 | | |
| Mordenite | 3,996,337 | | |

A particularly suitable zeolite catalyst used in the process of the invention is a porous crystalline metallosilicate designated as MCM-22. The catalyst is described in more complete detail in U.S. Pat. No. 4,954,325, the entire contents of which are incorporated by reference and reference should be made thereto for a description of the method of synthesizing the MCM-22 zeolite and the preferred method of its synthesis. Briefly; however, MCM-22 has a composition which has the following molar ranges:

$$X_2O_3:(n)YO_2$$

where X is a trivalent element, such as aluminum, boron, iron and/or gallium. Preferably X is aluminum. Y is a tetravalent element such as silicon and/or germanium preferably silicon and n is at least about 10, usually from about 10 to 150, more usually from about 10 to about 60, and even more usually from about 20 to about 40. In the as-synthesized form, zeolite MCM-22 in its anhydrous state and in terms of moles of oxides per n moles of $YO_2$, has the following formula $(0.005\text{–}0.1)Na_2O:(1\text{–}4)R:X_2O_3:nYO_2$ where R is an organic component. The Na and R components are associated with the zeolite as a result of their presence during crystallization, and are easily removed by known post-crystallization methods.

Representative examples of suitable naturally occurring zeolites include faujasite, mordenite, zeolites of the chabazite-type such as erionite, offretite, gmelinite and ferrierite.

Clay catalysts, another class of crystalline silicates, are hydrated aluminum silicates generalized by the following structural formula:

$Al_2O_3SiO_2.xH_2O$

Typical examples of suitable clays, which are acid-treated to increase their activity, are made from halloysites, kaolinites and bentonites composed of montmorillonite. These catalysts can be synthesized by known methods and are commercially available.

The catalysts suitable for use in this invention can be incorporated with a variety of known materials which are known to enhance the zeolite's resistance to temperature and reaction conditions of the conversion process of interest. These materials include other catalytically active materials such as other natural or synthetic crystalline silicates or inactive materials such as clays which are known to improve the crush strength of the catalyst or which act as binders for the catalyst. The catalyst can also be composited with a porous matrix. The porous matrix materials are well known in the art and are those which are advantageously used to facilitate extrusion of the catalyst.

The catalyst can be treated by steam stabilization techniques. These are known processes which are described in U.S. Pat. Nos. 4,663,492; 4,594,146; 4,522,929 and 4,429,176 the disclosures of which are incorporated herein by reference in their entireties.

PROCESS CONDITIONS

In the process of the instant invention the light cycle oil, which is preferably the effluent from the fluid catalytic cracker, is mixed with the alkylating agent and the catalyst. The reactants are contacted with the catalyst in a suitable reactor which contains a fixed bed of the catalyst composition under alkylation conditions. The conditions include temperatures ranging from at least about 150° F. to about 600° F., preferably from 300° F. to 500° F. The pressures can range from about 0.1 to 250 atmospheres preferably 0.1 to 100 atmospheres, the feed weight hourly space velocity can be from about 0.1 $hour^{-1}$ to 10 $hour^{-1}$, preferably from about 0.5 $hour^{-1}$ to 5.0 $hour^{-1}$ and the ratio of the reactants expressed in terms of moles of alkylating agent to moles of light cycle oil can range from about 0.1:1.0 to about 10.0:1.0, preferably from about 0.5:1 to about 5.0:1.0. The reactants can be in the vapor phase or the liquid phase and can be neat, i.e., free from intentional admixture or dilution with other materials or they can be brought into contact with the catalyst composition with the aid of a carrier gas or diluent such as hydrogen or nitrogen.

The reaction can be performed in any sequence; that is, the feed and the catalyst can be premixed and then the alkylating agent can be added. The process can be conducted in a continuous, semi-continuous or batch-type operation using a fixed or moving bed catalyst. In one embodiment, the light cycle oil is passed concurrently or countercurrently through a moving bed of the catalyst in particle form. Any coke formed on the catalyst is removed in a regeneration step involving exposing the catalyst to an elevated temperature and to an oxygen rich gas, such as air, after which the regenerated catalyst is recycled through the reactor to process more of the feed.

It was discovered that elevating the temperature of the process increases the yield of functional fluid; that is, the higher process temperature effects a greater conversion of light cycle oil to liquid fraction boiling above 600° F. (600° F.+). This aspect of the invention was found to be particularly advantageous for making refinery output adjustments adaptable to seasonal fluctuations in market demand for the light cycle oils. The reactor temperature can be increased to as high as about 600° F., preferably about 400° F.

The functional fluid yield at the lower process temperature, i.e, less than about 350° F., can be as high as 30% by weight, ranging from about 1.0 wt. % to 30 wt. % of stock boiling above 600° F. based on the weight of the entire reactor hydrocarbon feed, a more specific yield is from 5 wt. % to 25 wt. %. A higher process temperature, i.e., a temperature above about 450° F., improves the yield of functional fluid over 30%, ranging from about 20 wt. % to 70 wt. % of stock boiling above 600° F. based on the weight of the entire reactor hydrocarbon feed, a more specific yield is from about 30 wt. % to 50 wt. %.

The unconverted light cycle oil; that is, the fraction usually which boils below about 600° F. (600° F.−), for a light cycle oil boiling below 600° F., is substantially simultaneously upgraded by the process. The process significantly reduces the heteroatom content of the light cycle oil which results in a more stable and useful product. The amount of heteroatoms contained in the light cycle oil comprise sulfur atoms expressed in terms of weight percent of sulfur and nitrogen atoms expressed in terms of ppmw nitrogen. The extent of desulfurization of the light cycle oil can be as high as 70%, ranging from about 5% to 70% desulfurization, more specifically from 10% to 35% and the nitrogen atoms are almost completely removed. At the higher process temperatures, i.e., above 450° F., a greater degree of desulfurization occurs, i.e, above about 70%.

The functional fluid produced by the instant process can be characterized by the viscosity index (VI) which can range from 10 to 100, more specifically in the range of about 20 to 50, even more specifically from about 20 to 40, depending upon the molecular weight of the product which is attributed to the alkylating agent. Thus, when a heavier molecular weight product is obtained it will have a higher viscosity index and will be useful in lubricating fluids which are required to withstand higher temperatures such as automotive oils, diesel engine oils, and the like. The lower viscosity oils will be useful as hydraulic fluids or insulating oils, examples of which include the transformer oils, switch gear oils, cable oils, condenser oils, and heat transfer oils which often require a lower VI.

The following examples which were actually conducted describe the invention in further detail.

EXAMPLE 1

An MCM-22 zeolite was made in accordance with the process described in example 11 of U.S. Pat. No. 4,954,325.

EXAMPLE 2

An MCM-22 catalyst system was prepared by combining the MCM-22 zeolite catalyst of example 1 with an $Al_2O_3$ binder to form a catalyst system comprised of 65% zeolite and 35% $Al_2O_3$ binder.

Alkylation of a light cycle oil having the properties set forth in Table 1 was carried out in a 1 liter autoclave using an alpha $C_{14}$-olefin.

TABLE 1

| PROPERTIES OF A NARROW-CUT LIGHT CYCLE OIL | |
|---|---|
| H, wt. % | 9.14 |
| N, ppm | 180 |
| Basic N, ppm | 40 |
| S, wt. % | 3.5 |
| Bromine No. | 11.85 |
| MW | 165 |
| Hydrocarbon composition (wt. %) | |
| Paraffins | 21 |
| Naphthenes | 8 |
| Aromatics | 80 |
| Sim. Dist., °F. (D2887) | |
| IBP/5% | 408/444 |
| 10/20% | 448/455 |
| 30/40% | 479/487 |
| 50% | 492 |
| 60/70% | 497/500 |
| 80/90% | 508/522 |
| 95/EP% | 527/567 |

The detailed GC/MS analysis revealed that the light cycle oil contained a significant amount of two-ring aromatics (approximately 80%), primarily methyl substituted naphthalenes. In addition, this light cycle oil feedstock had a very high concentration of sulfur and nitrogen-containing compounds, 3.5 wt. % sulfur and 180 ppmw nitrogen. The sulfur-containing molecules were mostly composed of methyl-substituted benzothiophenes.

The relative molar proportion of the alpha $C_{14}$-olefin to the light cycle oil expressed in terms of a ratio was 1.2 moles of the alpha $C_{14}$-olefin to 1 mole of the light cycle oil (which, expressed in terms of weight percent, was 59 wt. % of an alpha $C_{14}$-olefin to 41 wt. % of a light cycle oil based on the total weight of the reactants). 5 wt. % of the above described MCM-22 catalyst was combined with the light cycle oil and the alpha $C_{14}$-olefin at 400° F. for 9 hours under a nitrogen atmosphere of 200 psig. The total liquid product was then vacuum distilled at 650° F. to obtain about 15 wt. % of alkylated light cycle oil boiling above 650° F. Table 2 set forth below provides a comparison of the properties of the light cycle oil feed before and after the alkylation reaction with the alkylated light cycle oil final product.

EXAMPLE 3

This example illustrates that increasing the reactor temperature increased the MCM-22 catalyst alkylation activity, resulting in a greater removal of heteroatom-containing compounds from the light cycle oil and a greater yield of alkylated light cycle oil-derived functional fluid stock. The alkylation reaction was carried out under identical conditions to Example 2 except that the reactor temperature was increased from 400° to 450° F. The alkylated light cycle oil-derived functional fluid product yield increased from 15 wt. % (as shown in Example 2) to 37 wt. %. The elevated reactor temperature also reduced the heteroatom content of the light cycle oil as shown by the increase in the sulfur removal: the weight % of sulfur removed from the light cycle oil by alkylation over MCM-22 at 400° F. was 31% (Example 2) while the weight % of sulfur removed from the light cycle oil was 51% at 450° F. (Example 3). The properties of the products of this example are reported in more detail in Table 2.

TABLE 2

| COMPARISON OF LCO PROPERTIES BEFORE AND AFTER ALKYLATION | LCO Feed of Example 1 | Example 2 (400° F.) | Example 3 (450° F.) |
|---|---|---|---|
| Feed Properties: | | | |
| S, wt.% | 3.5 | | |
| N, ppm | 180 | | |
| Basic N, ppm | 40 | | |
| 650° F.$^-$ Product | | | |
| S, wt.% | | 2.4 | 1.7 |
| N, ppm | | 2.0 | 2.0 |
| 650° F$^+$ Product | | | |
| S, wt.% | | 3.3 | 2.7 |
| N, ppm | | 200 | 72 |
| Basic N, ppm | | 25 | — |
| Pour Point, °F. | | −50 | −55 |
| KV @40° C., cSt | | 44.22 | 36.44 |
| KV @100° C., cSt | | 5.679 | 4.993 |
| Viscosity Index | | 47 | 31 |
| Weight percent product yield | | 15 | 37 |

As shown in Table 2, the results of the test indicate that the alkylation reaction of example 2 achieved about 31% desulfurization and almost complete denitrogenation of the light cycle oil feed. The high sulfur and nitrogen concentration, i.e., 3.3 wt. % and 200 ppmw, respectively, of the light cycle oil-derived functional fluid (400° F.) unexpectedly show that the MCM-22 catalyst was selective for alkylating the heteroatom-containing aromatics of the light cycle oil fraction. The higher molecular weight sulfur-containing alkylated aromatics separated into the heavier functional fluid fraction leaving behind an upgraded stabilized (heteroatoms and aromatics-reduced) light cycle oil, for example, having 2.4 wt. % S and 2.0 ppmw N (at 400° F.).

As shown in Table 2, the converted light cycle oil-derived functional fluid products of Examples 2 and 3 can be utilized as high quality functional fluid base stocks having a very low pour point (i.e., $<-50°$ F.) and a low VI ($>31$ VI).

The following examples illustrate the use of a narrow-cut coker gas oil having the properties set forth in Table 3 as the alkylating agent (replacing the alpha C-14 olefin of Example 2) in the light cycle oil conversion process. The properties of the light cycle oil used in the following examples are set forth in Table 3. The properties of the feedstock to undergo the alkylation reaction which comprised a blend of the coker gas oil and the light cycle oil are also presented in Table 3.

TABLE 3

| | Coker Gas Oil | LCO | Feed |
|---|---|---|---|
| Boiling Range (°F.) | 330 -550 | 330-550 | 330-550 |
| API Gravity | — | — | 26.8 |
| H, wt. % | 12.74 | 9.02 | 11.6 |
| N, ppm | 600 | 250 | 480 |
| S, wt. % | 2.7 | 3.4 | 2.9 |
| Bromine No. | 32.6 | 11.7 | 21.8 |

EXAMPLE 4

This light cycle oil conversion reaction was conducted for 18 hours in an autoclave at 100 psig, 450° F.

and using 15 wt. % of a commercial acid-treated kaolin clay catalyst marketed under the tradename Filtrol 13 in a weight ratio of 67:33%. After completion of the reaction the total liquid product was distilled at 600° F. to yield about 13 wt. % of the converted product which boiled above 600° F. The properties of the converted product and the unconverted product (the upgraded LCO which boiled below 600° F.) are presented in Table 4 below.

EXAMPLE 5

The LCO conversion reaction was carried out as described in Example 4 replacing the clay catalyst with a commercial FCC USY catalyst. The yield of converted LCO (boiling above 600° F. was about 28 wt. %. The properties of the converted and the unconverted LCO are presented in Table 4.

For comparative purposes the properties of the feedstock blend of light cycle oil and coker gas oil as an alkylating agent are also presented in Table 4.

EXAMPLE 6

The LCO conversion reaction was conducted as described in Example 4 replacing the clay catalyst with an MCM-22 catalyst. The yield of converted LCO (boiling above 600° F.) was about 11 wt. %.

TABLE 4

| | | Example 4 | | Example 5 | |
|---|---|---|---|---|---|
| Properties | Feed | 330–600° F. | 600° F.+ | 300–600° F. | 600° F.+ |
| Yield wt. % | — | — | 13 | — | 28 |
| API Gravity | 26.8 | 28.1 | — | 28.8 | — |
| N, ppm | 480 | 16 | 1500 | 2 | 390 |
| S, wt. % | 2.9 | 2.4 | — | 2.2 | 4.6 |
| Aniline Point °F. | 89.5 | 94.7 | — | 97.0 | — |
| Bromine No. | 21.8 | 21.3 | — | 11.72 | — |
| Diesel Index | 24.0 | 26.6 | — | 28.0 | — |

The results reported in Table 4 show that the conversion of a light cycle oil with a coker gas oil as an alkylating agent effectively upgrades both feedstocks by (1) converting the heteroatom containing aromatics of the light cycle oil to a higher molecular weight functional fluid which boils above about 600° F. and (2) reducing the heteroatom content and the aromatics content of the light cycle oil to produce an upgraded light cycle oil.

The following Table 5 presents a comparison of the oxidative stability of the alkylated light cycle oil functional fluids of examples 2 and 3 with a conventional mineral oil lubricant based on their performance in the Catalytic Oxidation Test. The conventional mineral oil lubricant was a light neutral mineral oil boiling in the range of 650° to 850° F. and having a relative proportion of paraffinic/naphthenic/aromatic components of 40/40/20. It will be noted that, regardless of the high heteroatom content (3.3 and 2.7 wt. % sulfur), the alkylated light cycle oil-derived functional fluid exhibited excellent oxidative stability which was superior to the conventional light neutral mineral oil lubricant.

The Catalytic Oxidation Test procedure consisted of subjecting a volume of the test functional fluid to a stream of air which was bubbled through the test composition at a rate of about 5 liters per hour for the specified number of hours and at the specified temperature. Present in the test composition were metals frequently found in engines, namely:

1) 15.5 square inches of a sand-blasted iron wire;
2) 0.78 square inches of a polished copper wire;
3) 0.87 square inches of a polished aluminum wire; and
4) 0.107 square inches of a polished lead surface.

The results of the test were presented in terms of change in percent of viscosity increase. The small change in viscosity meant that the functional fluid maintained its internal resistance to oxidative degradation under the conditions of the test.

TABLE 5

| Catalytic Oxidation Test (260° C. for 40 Hours) | |
|---|---|
| Lubricant Base Stock | % Viscosity Increase |
| Alkylated LCO Fluid of Example 2 | 15.8 |
| Alkylated LCO Fluid of Example 3 | 27.9 |
| Conventional Mineral Based Lubricating Oils | >150 |

Both alkylated light cycle oil functional fluids of Examples 2 and 3 demonstrated better oxidative stability than conventional mineral oils as indicated by the lower change in viscosity increase as compared to conventional mineral oils regardless of the relatively high sulfur and nitrogen content.

What is claimed is:

1. A process for converting a heteroatom-containing portion of a light cycle oil to a higher molecular weight product boiling in the lubricant boiling range comprising the steps of: contacting the light cycle oil in the presence of an alkylating agent which is a long chain olefin, the long chain olefin containing at least about 14 carbon atoms to about 24 carbon atoms with a crystalline metallosilicate catalyst under alkylation conditions sufficient to convert the heteroatom containing portion of the light cycle oil to the higher molecular weight product boiling in the lubricant boiling range; and, separating the higher molecular weight product boiling in the lubricant boiling range from unconverted light cycle oil.

2. The process as described in claim 1 in which the light cycle oil has an initial boiling point of at least about 400° F. and a final boiling point less than 750° F.

3. The process as described in claim 1 in which the light cycle oil contains an aromatics content in excess of 50 wt. % and hydrogen content below 14 wt. % and an API gravity below 30.

4. The process as described in claim 1 in which the alkylating agent is a source of olefinic hydrocarbon selected from the group consisting of FCC (fluid catalytically cracked) gasoline, FCC olefin streams, coker gas oil, and coker naphtha.

5. The process as described in claim 1 in which the alkylation conditions include a process temperature sufficient to effectuate a yield of lubricant boiling range product, which boils above about 600° F., of up to 30% by weight based on the entire weight of the product.

6. The process as described in claim 5 in which the process temperature is increased to a degree sufficient to effectuate a yield of lubricant boiling range product, which boils above about 600° F., over 30 wt. % based on the entire weight of the product.

7. The process as described in claim 1 in which the crystalline metallosilicate catalyst is a natural or synthetic zeolite or an acid-treated clay catalyst.

8. The process as described in claim 7 in which the zeolite catalyst is zeolite Beta, USY or MCM-22.

9. The process as described in claim 1 in which the mole ratio of the alkylating agent to the light cycle oil is in a range of about 0.1:1 to about 5:1.

10. The process of claim 4 in which the long chain olefin is derived from oligomerization and polymerization reactions of short chain olefins which contain from 2 to 5 carbon atoms.

11. The process of claim 1 in which the crystalline metallosilicate catalyst is an aluminosilicate catalyst.

12. The process as described in claim 1 in which the higher molecular weight lubricant boiling range product boils above 650° F. and has a viscosity index ranging from 10 to 100.

13. A process for improving a light cycle oil comprising the steps of:

a) contacting a heteroatom-containing portion of the light cycle oil with an alkylating agent which is a source of long chain olefinic hydrocarbons selected from the group consisting of an FCC (fluid catalytically cracked) gasoline, FCC olefin stream, coker gas oil and coker naphtha over a crystalline metallosilicate catalyst under conditions sufficient to effectuate a conversion of the heteroatom-containing portion to a converted fraction which boils above about 600° F.; and b) separating the converted fraction from unconverted light cycle oil, the light cycle oil having a reduced heteroatom content.

14. The process as described in claim 13 in which the light cycle oil has an initial boiling point of at least about 400° F. and a final boiling point less than 750° F.

15. The process as described in claim 13 in which the light cycle oil contains an aromatics content in excess of 50 wt. % and hydrogen content below 14 wt. % and an API gravity below 30.

16. The process as described in claim 13 in which the crystalline metallosilicate catalyst is a natural or synthetic zeolite or an acid-treated clay catalyst.

17. The process as described in claim 16 in which the zeolite catalyst is zeolite beta, USY or MCM-22.

18. The process of claim 13 in which the crystalline metallosilicate catalyst is an aluminosilicate catalyst.

19. A process for making a fluid boiling in the lubricant boiling range from a light cycle oil comprising the steps of:

a) alkylating a heteroatom-containing portion of the light cycle oil with an alkylating agent which is a high molecular weight olefin which contains at least about 8 carbon atoms to about 24 carbon atoms, over an MCM-22 zeolite-containing catalyst under conditions sufficient to effectuate alkylation of the heteroatom-containing portion of the light cycle oil whereby the heteroatom-containing portion is converted to a stable higher molecular weight lubricant boiling range fraction which has a viscosity index ranging from about 10 to 100; and b) separating the higher molecular weight lubricant boiling range fraction from unconverted light cycle oil.

20. The process as described in claim 19 in which the light cycle oil contains an aromatics content in excess of 50 wt. % and hydrogen content below 14 wt. % and an API gravity below 30.

21. The process as described in claim 19 in which the alkylating agent is a source of olefinic hydrocarbon selected from the group consisting of FCC (fluid catalytically cracked) gasoline, FCC olefinic streams, coker gas oil and coker naphtha.

22. The process as described in claim 19 in which the alkylating agent is derived from oligomerization or polymerization of short chain olefins which contain from 2 to 5 carbon atoms.

23. The process as described in claim 19 in which the higher molecular weight lubricant boiling range fraction has a boiling point above about 650° F.

24. The process as described in claim 19 in which the higher molecular weight lubricant boiling range fraction has a viscosity index ranging from 20 to 40.

* * * * *